US006705953B2

(12) United States Patent
Haskins

(10) Patent No.: US 6,705,953 B2
(45) Date of Patent: Mar. 16, 2004

(54) VISCOUS GOLF PRACTICE TURF

(75) Inventor: Michael Alan Haskins, Portage, IN (US)

(73) Assignee: Michael A. Haskins, Portage, IN (US)

( * ) Notice: Subject to any disclaimer, the term of this patent is extended or adjusted under 35 U.S.C. 154(b) by 0 days.

(21) Appl. No.: 10/063,916

(22) Filed: May 23, 2002

(65) Prior Publication Data

US 2003/0220152 A1 Nov. 27, 2003

(51) Int. Cl.[7] ..... A63B 69/36
(52) U.S. Cl. ..... 473/278; 473/150
(58) Field of Search ..... 473/278, 150, 473/160, 497, 499

(56) References Cited

U.S. PATENT DOCUMENTS

| | | | | |
|---|---|---|---|---|
| 3,639,923 A | | 2/1972 | Stewart | |
| 3,690,673 A | * | 9/1972 | Occhipinti | 473/160 |
| 3,712,628 A | * | 1/1973 | Boss, Jr. | 473/279 |
| 3,880,432 A | | 4/1975 | Coffey et al. | |
| 3,892,412 A | * | 7/1975 | Koo | 473/160 |
| 3,897,067 A | * | 7/1975 | Smith | 473/160 |
| 3,995,079 A | | 11/1976 | Haas | |
| 4,130,283 A | | 12/1978 | Lindquist | |
| 4,387,896 A | | 6/1983 | O'Brien | |
| 4,603,493 A | * | 8/1986 | Eston | 36/44 |
| 4,844,470 A | * | 7/1989 | Hammon et al. | 473/278 |
| 4,902,541 A | | 2/1990 | Martino | |
| 4,913,442 A | | 4/1990 | Walker | |
| 4,932,663 A | | 6/1990 | Makar | |
| 4,955,611 A | * | 9/1990 | Moller | 473/262 |
| 5,004,243 A | | 4/1991 | Dlouhy | |
| 5,026,580 A | | 6/1991 | Hammon | |
| 5,028,052 A | | 7/1991 | Miller | |
| 5,035,433 A | | 7/1991 | Durso | |
| 5,067,255 A | * | 11/1991 | Hutcheson | 36/43 |
| 5,156,398 A | * | 10/1992 | Kibamoto | 473/278 |
| 5,205,562 A | | 4/1993 | Hammon | |
| 5,273,285 A | | 12/1993 | Long | |
| 5,441,265 A | * | 8/1995 | Codlin | 473/160 |
| 5,456,471 A | * | 10/1995 | MacDonald | 473/278 |
| 5,593,355 A | * | 1/1997 | Beaver | 473/278 |
| 5,692,967 A | * | 12/1997 | Guyer | 473/262 |
| 5,830,080 A | | 11/1998 | Reynolds | |
| 5,897,443 A | * | 4/1999 | Glaser | 473/279 |
| 6,001,026 A | * | 12/1999 | Breneman | 473/261 |
| 6,139,443 A | | 10/2000 | Reynolds | |
| 6,155,931 A | * | 12/2000 | Perrine | 473/278 |
| 6,413,166 B1 | * | 7/2002 | Long | 473/160 |

* cited by examiner

*Primary Examiner*—Sebastiano Passaniti
*Assistant Examiner*—Nini F. Legesse
(74) *Attorney, Agent, or Firm*—Harold J. Fassnacht, Esq.; Bullwinkel Partners, Ltd

(57) ABSTRACT

A fluid-based, synthetic grass golf practice-swinging platform. The present invention has a fluid bladder holder which holds a fluid bladder filled with at least one viscous fluid. The present invention also has a golfer stance platform which is horizontally planar and connected to the fluid bladder holder. The complete assembly is overlaid with conventional synthetic grass material. The fluid contained within the fluid bladder provides realistic natural grass turf characteristics and properties by replicating wave propagation within the viscous fluid. The fluid type and viscosity can be varied depending upon the type of natural turf being replicated.

13 Claims, 3 Drawing Sheets

VISCOUS GOLF PRACTICE TURF

BACKGROUND OF THE INVENTION

The present invention relates generally to artificial grass surfaces which replicate the physical characteristics and properties of natural golf course turf. More particularly, the present invention relates to an artificial grass golf practicing mat which replicates the feel, feedback and resultant ball velocity and trajectory experienced with natural turf when a conventional golf club is used to hit a golf ball.

During a conventional golf swing, the golfer lines the club up with a golf ball which lies on the grass surface. During the swing motion, the golf club generally, and preferably, impacts the ball slightly below the ball's mid-height lateral surface to create the desired amount of vertical trajectory. To achieve the desired outcome, the golf club head must travel through the uppermost part of the grass surface during the follow through. Thus, upon impact, it is common for divots, which are small pockets of grass material, to be removed during a golf swing due to the shear forces created internally within the turf itself. Divots are also important in that they provide the feeling feedback to the golfer, allow a complete follow through, and provide a more controlled and accurate resultant golf ball velocity and trajectory. Natural grass surfaces have the ability to absorb the impact of the golf club during the golf club swing due mostly in part to the underlying compressibility and impact absorbing properties of the soil substructure. As such, the golfer generally does not feel the golf club head hit the grass surface and an optimal amount of the golf club's kinetic energy is imparted to the golf ball.

In order to perfect a golf swing and resultant ball trajectory, a golfer must repetitively practice the golf swing motions and the stance during the swing. As such, it is desirable for the golfer to repeatedly practice this swinging motion in a designated area. However, as explained above, with the inherent divot creation during a normal golf swing, natural grass surfaces are not practical for a golf swing practice location due to the inevitable numerous divots created, which would subsequently render the golf practice area useless within a very short period of time.

There has thus been a long-standing need within the golfing art to replicate the feel and feedback of natural grass surfaces for golf practice locations. Currently, artificial grass surfaces are utilized mainly for golf practicing, wherein a golfer can actively practice his golf swing within such a designated area. Artificial grass surfaces are generally preferred over natural grass surfaces for golf practice swinging due to the fact that artificial grass has greater longevity, is not prone to naturally occurring divots, is generally more customizable, and is less costly to maintain.

However, a major problem with creating a consistent and practical artificial grass surface is to create a natural feel to the synthetic grass surface and underlying core substructure. For example, some conventional golf practice artificial grass surfaces consist of a polymer based artificial grass leaf material overlaid on a hardened surface, such as wood, concrete or the like. A major limitation of such an artificial golf practice swing surface is the lack of realistic replication of the underlying soil substructure or turf. As such, and as described above, when the golf club hits the artificial grass surface during a normal golf swing, and since the underlying surface does not have adequate compressive abilities or impact absorbing properties, the swing path of the golf club is redirected to a plane parallel to the grass surface thereby not allowing a follow through consistent with that experienced on natural turf wherein a divot is taken. Furthermore, when the golf club hits the hardened underlying surface, more often than not, the impact by the golf club creates undesirable and potentially dangerous shocks and vibrations to the golfer, thus possibly physically harming the golfer as well as damaging the golf club itself.

U.S. Pat. No. 5,830,080 ('080), to Reynolds on Nov. 3, 1998, attempts to solve this problem by creating a turf simulation surface for golf practice swings. The '080 patent discloses the use of two independent components simulating the first two layers of natural soil and is a composite mat comprising an integral pile section, an underlying plastic foam layer and a rimmed base that simulates the supporting properties of the deeper layers of natural soil. However, a limitation of the '080 patent is that the invention does not accurately replicate the responsive action of natural soil due to the static properties of the composite materials. Furthermore, the repetitive golf practice swinging action detrimentally degrades the surface of the '080 patent by producing permanent damage. As such, the '080 invention is not a good replacement for natural grass surfaces. The present invention overcomes this limitation by, for example, providing a fluid based core which more accurately replicates natural soil characteristics and properties due to the fluid's viscosity and dynamic properties. By utilizing such a fluid based core, the present invention allows a golf club head to impart an optimal amount of its kinetic energy to the golf ball and underlying substructure material without substantial surface material damage thus more accurately replicating the dynamic stresses associated with taking a divot from natural grass more precisely.

U.S. Pat. No. 3,639,923 ('923), to Steward on Feb. 8, 1972, discloses a tiltable golf practice platform. The '923 invention utilizes a plurality of spring responsive legs which are mounted to a planar pivotable platform. As such, when the golfer's center of gravity naturally changes during a conventional golf swing, the '923 patent has the ability to retroactively compensate for the weight distribution, thus attempting to provide a more realistic feel. Furthermore, the '923 patent discloses the use of an artificial turf surface overlaid on a pad of cellular elastomeric material which attempts to recreate soil characteristics. However, a limitation of the '923 patent is that the cellular elastomeric material does not accurately replicate the underlying substructure of a natural grass turf surface. The present invention overcomes this limitation by, for example, providing a fluid based core which realistically absorbs and dissipates the kinetic energy imparted from a golf club swing.

U.S. Pat. No. 4,130,283 ('283), to Lindquist on Dec. 19, 1978, discloses a simulated fairway surface for golf apparatus. The '283 invention uses a spring loaded sled which moves in a planar direction to the golfer's stance location. As such, upon hitting the golf ball, the sled absorbs the golf club energy by moving in a planar direction until the spring's tensile forces cause the sled to stop and return to its original position. Furthermore, the '283 invention's surface is compressible, which attempts to replicate natural grass. However, a limitation of the '283 patent is that by simply moving in a planar direction does not realistically replicate the characteristics and properties of natural grass surfaces. Furthermore, due to the planar moving sled, the '283 patent is more prone to malfunction and require enhanced maintenance. The present invention overcomes this limitation by, for example, not requiring a movable sled and by realistically imitating the dynamic stresses associated with taking a divot from natural surfaces.

U.S. Pat. No. 4,932,663 ('663), to Makar on Jun. 12, 1990, discloses a golf practice swing tee mat. The '663 patent uses a tension/compression spring system which provides a trampoline-like grass surface. As such, upon imparting the axial forces of the golf club to the golf ball and artificial grass surface, the artificial grass surface simply moves in downward axial direction to compensate for such forces. However, a limitation of the '663 patent is that such downward movement does not realistically portray natural grass' characteristics and movement during a golf swing. Furthermore, the '663 invention requires continuous maintenance to ensure that the tensile and compressive springs are properly aligned and secured. The present invention overcomes such limitations by, for example, providing a fluid based core which more realistically replicates the dynamic stresses associated with taking a divot from natural turf, and by not requiring the use of any type of spring mechanism which would required enhanced maintenance.

U.S. Pat. No. 5,205,562 ('562), to Hammon on Apr. 27, 1993, discloses a golf ball driving range mat. The '562 invention uses a felt carpet material to resemble natural grass material interweaved into a top pad material. The top pad material is then loosely connected to a base pad and may be raised at its center for replacement of the tee. The top pad also has the ability to absorb energy from the golf club swing due to its ability to move relative to the base pad when it is struck due, in part, to its loose connectivity. However, limitations of the '562 invention include the lack of downward force absorbing properties which replicate the realistic feel of natural grass surfaces. Furthermore, with the loosely connected top pad, which is designed to only move horizontally relative to the base pad, requires frequent maintenance to ensure a secure connection. The present invention overcomes these limitations by, for example, providing the ability to absorb and dissipate energy resultant from a golf club swing in both horizontal and vertical directions. Furthermore, the present invention does not require extended maintenance and does not have any loosely fitted connections which have the ability to fail.

The present invention overcomes the disadvantages and/or shortcomings of known prior art artificial turf golf practice swing mats and provides a significant improvement thereover.

BRIEF SUMMARY OF THE INVENTION

It is an object of the present invention to replicate the impact absorbing and energy dissipation characteristics and properties of natural grass turf surfaces.

It is another object of the present invention to create a reliable and reusable golf swing practice mat which requires minimal maintenance.

It is yet another object of the present invention to create a golf swing practice mat which is customizable to replicate numerous types of grass and soil surfaces.

The present invention consists of an artificial grass surface overlaid on a fluid core substructure. The fluid core substructure has the ability to reliably and realistically absorb the impact of a conventional golf swing while allowing the transmission of an optimal amount of the golf swing's kinetic energy to the golf ball. As such, the fluid core substructure closely replicates the properties and characteristics of natural grass golf surfaces, thus providing a realistically feeling and usable golf practice swing location.

The preferred embodiment of the present invention consists of a fluid core substructure holder, a fluid core substructure, synthetic grass material, and an adjacent golfer stance location of which the top is co-planar with the top of the fluid core substructure. As such, the fluid core substructure and the adjacent golfer stance location can both be overlaid with conventional synthetic grass material, thus providing a realistic and contiguous grass surface appearance and experience.

Within the preferred embodiment of the present invention, conventional synthetic grass material, such as polymer interwoven material, is adhesively bonded onto the fluid core substructure encasement membrane material. The encasement membrane material is made of a pliable, non-reactive material such as polyvinyl chloride, vinyl or other resilient plastics having the ability of transmitting shear forces within the fluid core. The fluid core substructure is then held within a fluid core substructure holder which is geometrically optimized to efficiently retain and protect the fluid core substructure as well as control the fluid dynamic properties of the contained fluid within the fluid core substructure.

The fluid contained in the fluid core substructure can be of varying viscosities, depending upon the desired composite stiffness and viscosity of the golf practice composite. For example, if it is desirable to replicate the feel and interaction of golf course turf naturally found in the southern United States the viscosity of the fluid core can be increased in order to realistically replicate drier soil properties. As another example, if it is desirable to have a sand trap like feel and interaction, the viscosity of the fluid core can be lessened in order to realistically replicate sand properties. Furthermore, the present invention can simultaneously utilize a plurality of different, non-interactive fluids of varying viscosities within the fluid core substructure to create a gradient effect, thus more closely resembling the differing energy absorption properties of natural soil as a golf club travels through its surface.

The present invention also contains a tee holder clip adjacent to the fluid core substructure. As such, the golf tee height and location can be controlled wherein the possibility of puncturing the fluid core substructure is minimized.

BRIEF DESCRIPTION OF THE SEVERAL VIEWS OF THE DRAWINGS

The preferred embodiment is herein described in detail with references to the drawings, where appropriate, wherein.

DETAILED DESCRIPTION OF THE INVENTION

The preferred embodiment of the present invention is best described as a fluid core grass emulation surface. The present invention has the ability of absorbing the impact shocks and resultant forces of a conventional golf club swing while realistically and reliably replicating the natural characteristics and properties of natural grass surfaces. As such, due to the preferred embodiment's fluid core material, the present invention has the ability of accurately transferring the kinetic energy of a swinging golf club to a conventional golf ball, thus resulting in realistic golf ball velocity, trajectory and rotation.

Figure 1:
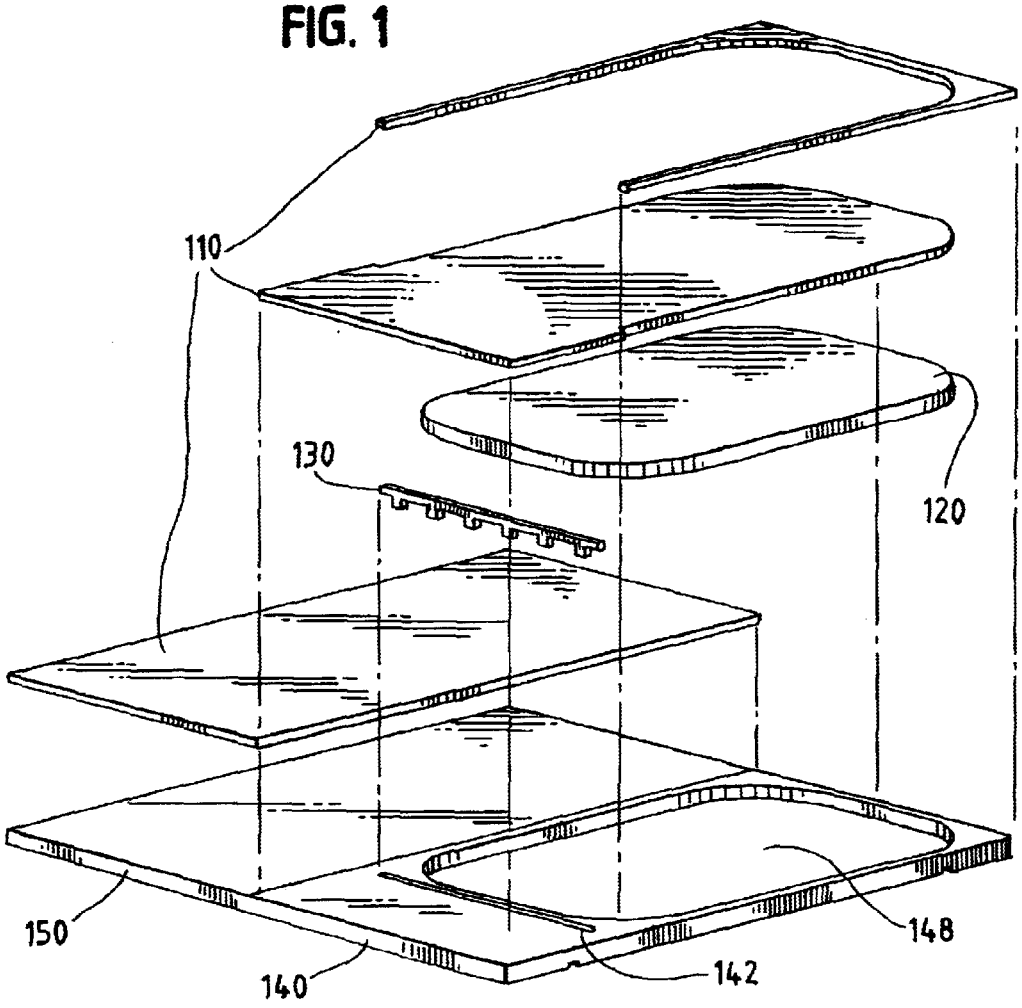
FIG. 1 is a detailed exploded perspective view of the preferred embodiment of the present invention detailing the practice stance location, the fluid core substructure, the fluid core substructure holder and the placement of synthetic grass materials.

Referring to FIG. 1, the preferred embodiment of the present invention consists of conventional synthetic grass material 110, such as nylon, polypropylene or polyolefin based grass blade emulating materials, a fluid core encasement bladder 120, a fluid core platform 140, and a golfer stance platform 150. The golfer stance platform 150 is preferably horizontally planar and level to the fluid core platform 140, thus providing a contiguous and level plane. Alternately, in order to ensure planar conformity and levelness, the golfer stance platform 150 and the fluid core platform 140 can have adjustable feet on the bottom side of each, thus providing the ability to independently level both. The golfer stance platform 150 is preferably detachably connected to the fluid core platform 140, in order to facilitate easy and versatile disassembly and transportation. Alternately, the golfer stance platform 150 can be fixedly attached to the fluid core platform 140. Still alternately, the golfer stance platform 150 can be connected via hinge connections to the fluid core platform 140 to facilitate the folding over of the golfer stance platform 150 onto the fluid core platform 140, once again to enhance transportability of the present invention.

Within the preferred embodiment of the present invention, the fluid core encasement bladder 120 is constructed of a pliable, material. Preferably, the material is resilient and is non-reactive with any fluids that are encased. The preferred material is selected from the groups consisting essentially of vinyl, latex, urethane, polyvinyl chloride, and composite flexible materials. It is to be understood, of course, that other pliable, puncture resistant materials can be substituted for the fluid core encasement bladder 120 material without deviating from the true spirit and scope of the present invention.

Referring to FIGS. 1, 2, 8 and 9, it can be seen that it is intended that the preferred embodiment of the present invention utilizes a conventional golf swing's kinetic energy to create a wave within the fluid encased within the fluid core encasement bladder 120. As such, the created wave has the ability to naturally transfer the proper proportion of the kinetic energy of the golf swing to the simulated turf surface and to permit the golf club face to traverse the lateral surface of the golf ball, thus resulting in the desired vertical and horizontal forces which produce the golf ball's velocity, trajectory and rotation. The resultant feel and golf ball velocity, trajectory and rotation are very similar to a golf ball hit on a natural grass surface. As such, the viscosity and characteristics of the fluid core dictate the type and size of wave production, thus replicating the desired soil type. For example, if sand trap properties are desired, then the viscosity of the fluid core within the preferred embodiment can be modified to readily replicate the wave forces found within sand trap soil materials.

As such, within the preferred embodiment of the present invention, the fluid core encasement bladder 120 is filled with a fluid material having viscous properties consistent with the type of natural soil to be replicated. The liquid preferably has a viscosity of about 0.1 cs to 30,000 cs, depending upon the desired soil type which is being replicated. Alternately, fluids of other viscosities can be utilized. The preferred fluid is a silicone-based fluid, preferably selected from the group consisting essentially of dimethylpolysiloxane, methylalkylpolysiloxane, and chloronatedphenylmethylpolysiloxane. These-materials have been found to reliably and realistically replicate a majority of natural grass surfaces typically found on common golf courses, while still exhibiting prolonged and stable dynamic properties. Alternately, other types of fluids can be used. Examples of other types of fluids include, but are not limited to, water, fluid polymers, dissolved salts, petroleum based fluids, and the like. Once again, the type of fluid used depends upon the type of natural soil characteristics which are being replicated.

Still alternately, the present invention can be utilized with a plurality of non-interacting fluids with differing viscosities and densities simultaneously contained within the fluid core encasement bladder 120. As such, within this embodiment of the present invention, a more natural soil characteristic effect can be created due to the gradient viscosity properties created by the fluids. In this scenario, the greater the shock wave forces penetrate the different gradient layered fluids, the greater the interactive forces returned by the different fluids are, thus not only interacting with each other within the fluid core encasement bladder 120, but also upon the golf ball.

In order to better control the reactive wave forces and to prevent their continued reverberation within the fluid core encasement bladder 120, the fluid core holder 140 preferably has rounded interior walls around the periphery of the fluid core holder cavity 148 in order to effectively dissipate and absorb any resultant waves. Furthermore, the preferred fluid core holder 140 is constructed of a durable material, such as hardened polymers, fiberglass, metals and the like. Alternately, the fluid core holder 140 and stance platform 150 can be constructed of a more flexible durable material, such as natural rubber, synthetic rubber, or other semi-rigid polymer or composite material.

To ensure that the fluid core encasement bladder 120 does not get punctured by the placement of a golf tee, the preferred embodiment of the present invention incorporates a golf tee holder 130, which is interactively placed within the golf tee holder channel 142. Preferably, the golf tee holder 130 is a compressive clip type tee holder which frictionally holds the tee in place. Alternately, other types of golf tee holders can be used, such as penetrable gel foams which the tee can penetrate and frictionally engage, predrilled materials to readily receive the tee, or permanent golf tees.

Within the preferred embodiment, assembly of the present invention occurs by placing the fluid core encasement membrane 120 into the fluid core holder cavity 148. Next, the golf tee holder 130 is detachably inserted into the golf tee holder channel 142. After assembly, the preferred synthetic grass material 110 is placed over the entire present invention to create a contiguous surface appearance and feel. Within the preferred embodiment of the present invention, the synthetic grass material 110 contains a plurality of interconnected pieces, which provide independent removal and replacement if the need arises. Alternately, the synthetic grass material 110 can be a single piece of material which is contiguous. The synthetic grass material 110 is preferably adhesively attached to the present invention. Alternately, the synthetic grass material can be detachably connected with, for example, but not limited to, conventional loop and hook fasteners, bolts, adhesive tapes, and the like.

Figure 4:
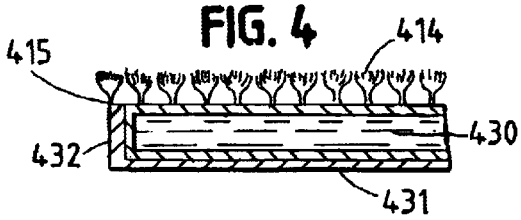
FIG. 4 is a detailed cross-sectional view of the preferred embodiment's fluid core substructure.
Figure 5:
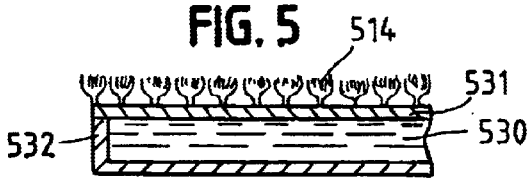
FIG. 5 is a detailed cross-sectional view of an alternate embodiment fluid core substructure.
Figure 6:
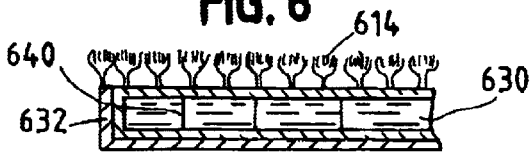
FIG. 6 is a detailed cross-sectional view of another alternate embodiment's fluid core substructure.
Figure 7:
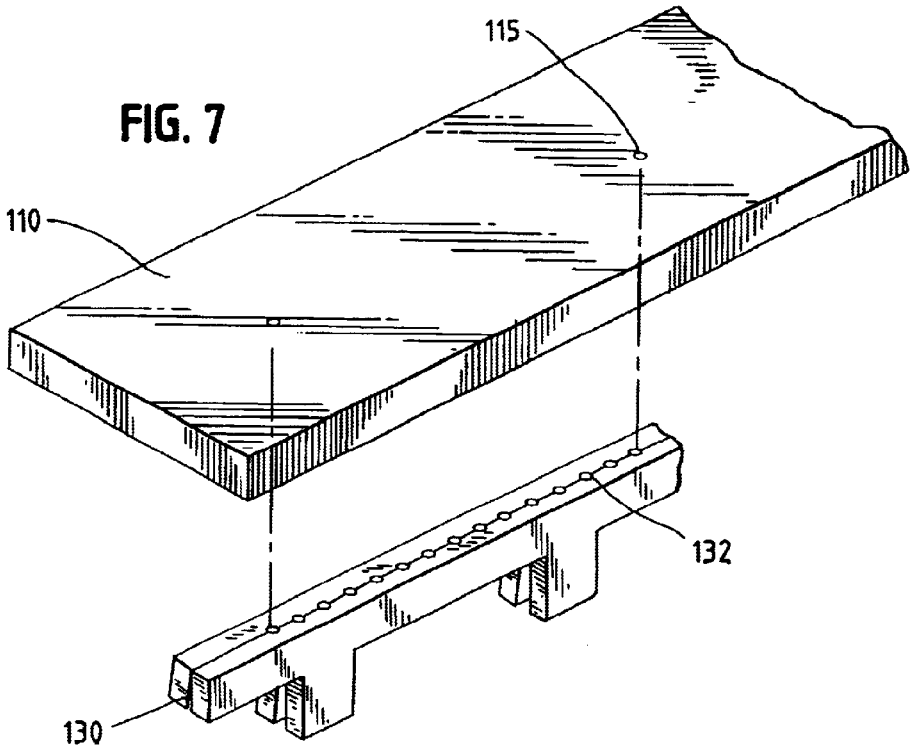
FIG. 7 is a schematic view of the preferred embodiment's tee holder apparatus.
Figure 8:
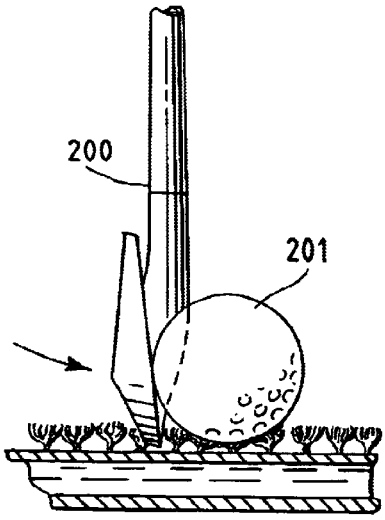
FIG. 8 is a schematic representation of a typical golf ball swing hitting a golf ball just prior to impact.
Figure 9:
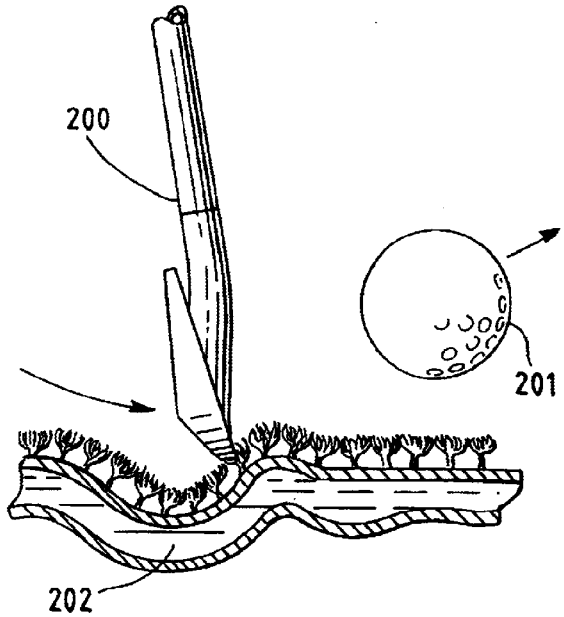
FIG. 9 is a schematic representation of a typical golf ball swing hitting a golf ball just after impact noting the preferred embodiment's reactions to the golf club impact.

Referring to FIG. 4, which is a cross sectional representation of the preferred embodiment, and FIGS. 5 and 6, which are cross sectional representations of alternate embodiments of the present invention, within the preferred embodiment of the present invention, and as discussed above, the fluid core 430 is encased within the fluid core encasement bladder 431, which in turn is contained within the fluid core holder 432. Synthetic grass material 414 is preferably adhesively bonded to the upper surface of the independent fluid core encasement bladder 431 at the synthetic grass material/fluid core encasement bladder intersection 415. In an alternate embodiment of the present invention, the fluid core 530 can be contained by a film of the fluid core encasement bladder material 531 adhesively bonded to the fluid core holder rim 532. The synthetic grass material 514 can be adhesively bonded to or interwoven into the fluid core encasement bladder film 531, thus decreasing the amount of material needed during construction. Still alternately, and to further control the impact wave properties of the contained core fluid, interspaced support ribs 640 can be placed within the fluid core 630 to dissipate and absorb reverberation wave forces within the fluid core holder 632.

Figure 3:
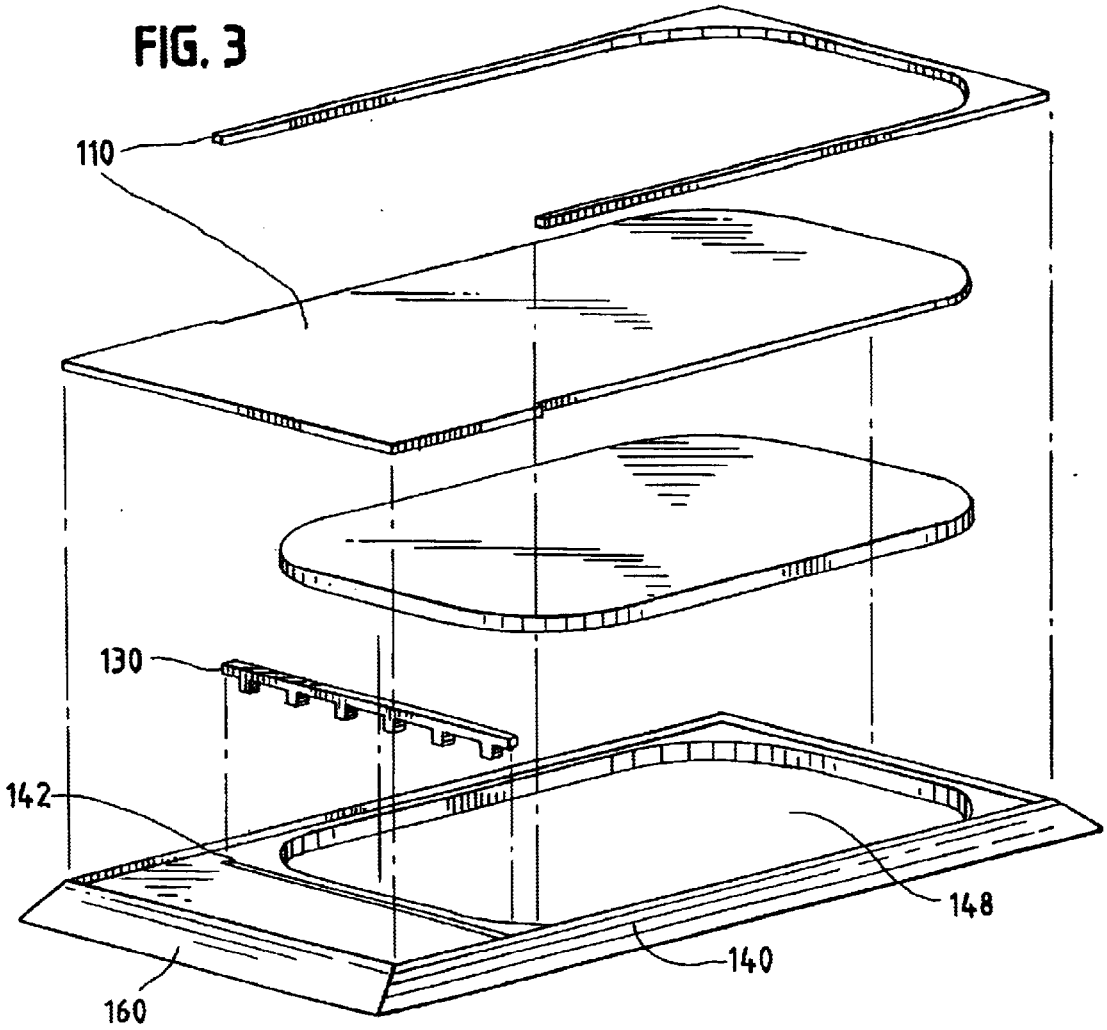
FIG. 3 is a detailed exploded perspective view of an alternate embodiment of the present invention intended to be placed within natural soil.

Referring to FIG. 3, in still another alternate embodiment of the present invention, the fluid core holder 140 has trapezoidal exterior edge surfaces 160 to facilitate direct placement of the fluid core holder 140 into natural ground. The trapezoidal exterior edge surfaces 160 will provide the fluid core holder 140 with enough reactive forces to maintain the fluid core holder's 140 static position in the natural ground when it is being utilized.

Figure 2:
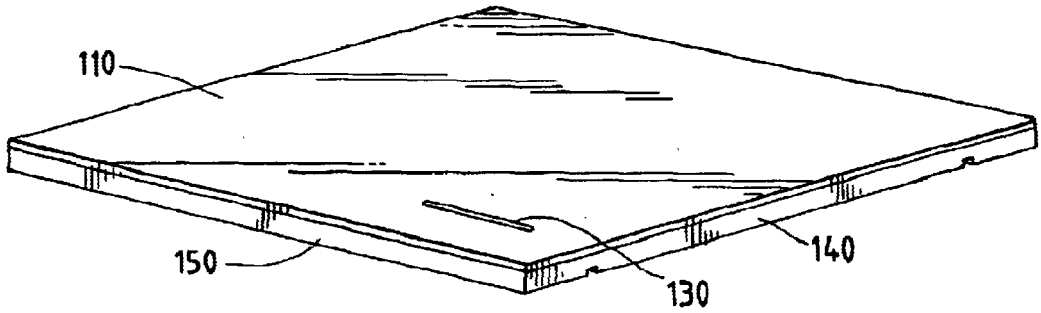
FIG. 2 is a perspective view of the preferred embodiment of the present invention in an assembled condition.

Referring to FIG. 2, the preferred embodiment of the present invention is between 1 inch to 2 inches thick in an assembled condition. Alternately, the thickness can be outside of this preferable range depending upon the type of soil characteristics which are being replicated, the type of materials used, the type of fluid core material used, and the like. As such, the 1 to 2 inch range of the preferred embodiment of the present invention shall be taken as an exemplification of the present invention, rather than a limitation thereof.

While preferred and alternate embodiments have been described herein, it is to be understood that these descriptions are only illustrative and are thus exemplifications of the present invention and shall not be construed as limiting. It is to be expected that others will contemplate differences, which, while different from the foregoing description, do not depart from the true spirit and scope of the present invention herein described and claimed.

What is claimed is:

1. A synthetic grass surface golf practice swinging apparatus for simulating the dynamic response of actual turf when a golf ball resting upon said surface is hit with a golf club, comprising a. a hollow base containing a depression and having an upper horizontal surface;

b. a flexible bladder retained within said depression, said bladder having an exposed upper surface substantially coplanar with said upper horizontal surface, c. a synthetic grass sheet material adhesively bonded to the exposed upper surface of said flexible bladder and capable of supporting a golf ball in hitting position; and d. said flexible bladder being substantially filled with two or more viscous liquids of different viscosities which, when a golf ball is hit off of said synthetic grass sheet material, simulates the dynamic response of actual turf.

2. An apparatus as claimed in claim 1 wherein at least one of said viscous liquids is a silicone based liquid.

3. An apparatus as claimed in claim 2 wherein at least one of said silicone based liquids is selected from the group consisting essentially of dimethylpolysiloxane, methylalkylpolysiloxane, and chloronatedphenylmethylpolysiloxane.

4. An apparatus as claimed in claim 1 wherein at least one of said liquids is selected from the group consisting essentially of fluid polymers, water containing dissolved salts and petroleum.

5. An apparatus as claimed in claim 1 in which said flexible bladder contains internal ribs for resisting the unrestricted propagation of waves in the viscous liquids.

6. An apparatus as claimed in claim 1 wherein said fluid bladder holder depression has rounded internal walls for interrupting and dissipating undesirable longitudinal reverberation in the viscous fluid resulting from the hitting of a golf ball off of said synthetic grass sheet material.

7. An apparatus as claimed in claim 1 wherein said bladder holder has a plurality of adjustable leveling legs adapted to maintain said bladder upper surface in a horizontal position.

8. An apparatus as claimed in claim 1 further comprising a golf tee holder, said golf tee holder being detachably connected to said hollow base adjacent to said flexible bladder.

9. An apparatus as claimed in claim 1 wherein said fluid bladder holder has external trapezoidal peripheral edges, said edges adapted to be placed into natural earth for resisting movement from the hitting of a golf ball off of said synthetic grass sheet material.

10. A synthetic grass surface golf practice swinging apparatus for simulating the dynamic response of actual turf when a golf ball resting upon said surface is hit with a golf club, comprising a. a hollow base containing a depression and having an upper horizontal surface;

b. a flexible bladder retained within said depression, said bladder having an exposed upper surface substantially coplanar with said upper horizontal surface;

c. a synthetic grass sheet material adhesively bonded to the exposed upper surface of said flexible bladder and capable of supporting a golf ball in hitting position;

d. said flexible bladder being substantially filled with a viscous liquid, which, when a golf ball is hit off of said synthetic grass sheet material, simulates the dynamic response of actual turf; and e. said flexible bladder containing internal ribs for resisting the unrestricted propagation of waves in the viscous liquid.

11. An apparatus as claimed in claim 10 wherein said viscous liquid is a silicone based liquid.

12. An apparatus as claimed in claim 11 wherein said silicone based liquid is selected from the group consisting essentially of dimethylpolysiloxane, methylalkylpolysiloxane, and chloronatedphenylmethylpolysiloxane.

13. An apparatus as claimed in claim 10 wherein said liquid is selected from the group consisting essentially of fluid polymers, water containing dissolved salts and petroleum.

* * * * *